US005365766A

United States Patent [19]

Takahashi et al.

[11] Patent Number: 5,365,766

[45] Date of Patent: Nov. 22, 1994

[54] DIE ASSEMBLY HAVING MEANS FOR AUTOMATICALLY CONTROLLING IN THE ANGULAR ORIENTATION OF THE LOWER DIE PLATE MEMBERS

[75] Inventors: Yukio Takahashi, La Habra; Etsuo Fukuda, Cerritos, both of Calif.

[73] Assignee: Amada Engineering & Service Co., Inc., La Mirada, Calif.

[21] Appl. No.: 62,759

[22] Filed: May 18, 1993

[51] Int. Cl.[5] ..... B21D 5/01

[52] U.S. Cl. ..... 72/387; 72/389; 72/396

[58] Field of Search ..... 72/386, 387, 389, 396, 72/478

[56] References Cited

U.S. PATENT DOCUMENTS

| | | | |
|---|---|---|---|
| 2,882,952 | 4/1959 | Johnson | 72/396 |
| 2,916,073 | 12/1959 | Johnson | 72/396 |
| 3,306,093 | 2/1967 | Sassak | 72/389 |
| 5,060,501 | 10/1991 | Heath | 72/389 |

FOREIGN PATENT DOCUMENTS

| | | | |
|---|---|---|---|
| 0124317 | 5/1991 | Japan | 72/389 |
| 0138669 | 1/1953 | Sweden | 72/389 |
| 0576141 | 10/1977 | U.S.S.R. | 72/389 |

*Primary Examiner*—David Jones
*Attorney, Agent, or Firm*—Irving Keschner

[57] ABSTRACT

A die assembly for use with a tool for bending flat metal stock, and including a pair of elongated plate members in the lower die member each having a surface to support a piece of flat metal stock, the plate members being pivotably connected and maintained approximately 180 degrees apart when a bending force is not applied to the metal stock. A surface of an expandable pressure container is positioned in contact with a plate support member, the pressure within the container being controlled in a manner such that the vertical position of the plate support member is fixed such that the plate members assume a selected angular orientation to enable the tool to form the desired bend in the metal stock.

8 Claims, 4 Drawing Sheets

DIE ASSEMBLY HAVING MEANS FOR AUTOMATICALLY CONTROLLING IN THE ANGULAR ORIENTATION OF THE LOWER DIE PLATE MEMBERS

BACKGROUND OF THE INVENTION

1. Field of the Invention

The present invention relates to a die for a bending flat metal stock and, in particular, a means for controlling the angular orientation of the lower die plate members supporting the metal stock.

2. Description of the Prior Art

A number of prior art flat metal bending dies have been disclosed in the prior art. For example, U.S. Pat. No. 5,060,501 to Heath discloses a flat metal bending die which incorporates two elongated die bars supported for both translational and pivotal movement, the wedge shaped cross-sectional shape of the die bars facilitating the angular bending of flat metal stock without the typical material scoring caused by relative movement between the die bars and the flat metal stock during a bending operation. Although the Heath apparatus disclosed is used to bend stock in a 90 degree bend and it is noted that the die assembly could be modified to bend stock into other angular configurations, it is apparent that significant modifications would be required to accommodate various bending angles.

The concept of using a lower die member having pivotable members, as shown in Heath, in forming metal parts in itself has been known in the prior art for many years. For example, U.S. Pat. No. 240,174 to Pearce, issued on Apr. 12, 1881 discloses a die having pivotable block members secured in a base die the block members moving from an initial first angular orientation to a second orientation as the part is being formed.

Currently, however, there is no sheet metal processing die assembly available whereon the angularly orientation of the V-shaped female die member (lower bending tool), utilized to bend sheet metal into precise angles, can be automatically adjusted in a cost efficient manner. The adjustments are conventionally made by changing the components of the female die member, a costly and labor intensive process.

What is therefore desired is to provide an improved die assembly wherein the angular orientation of the plate members forming the lower die member can be adjusted in a more cost effective manner than has heretofore been available.

SUMMARY OF THE PRESENT INVENTION

The present invention provides a die assembly comprising a tool for bending flat metal stock, and a pair of elongated plate members each having a surface to support a piece of flat metal stock, the plate members being pivotably connected and maintained approximately 180 degrees apart when a bending force is not applied to the metal stock. A surface of an expandable pressure container is positioned in contact with a plate support member, the pressure within the container being controlled in a manner such that the vertical position of the plate support member is fixed such that the plate members assume the selected angular orientation to enable the tool to form the desired bend in the metal stock.

BRIEF DESCRIPTION OF THE DRAWING

For a better understanding of the invention as well as other objects and further features thereof, reference is made to the following description which is to be read in conjunction with the accompanying drawing wherein.

DESCRIPTION OF THE INVENTION

Figure 1:
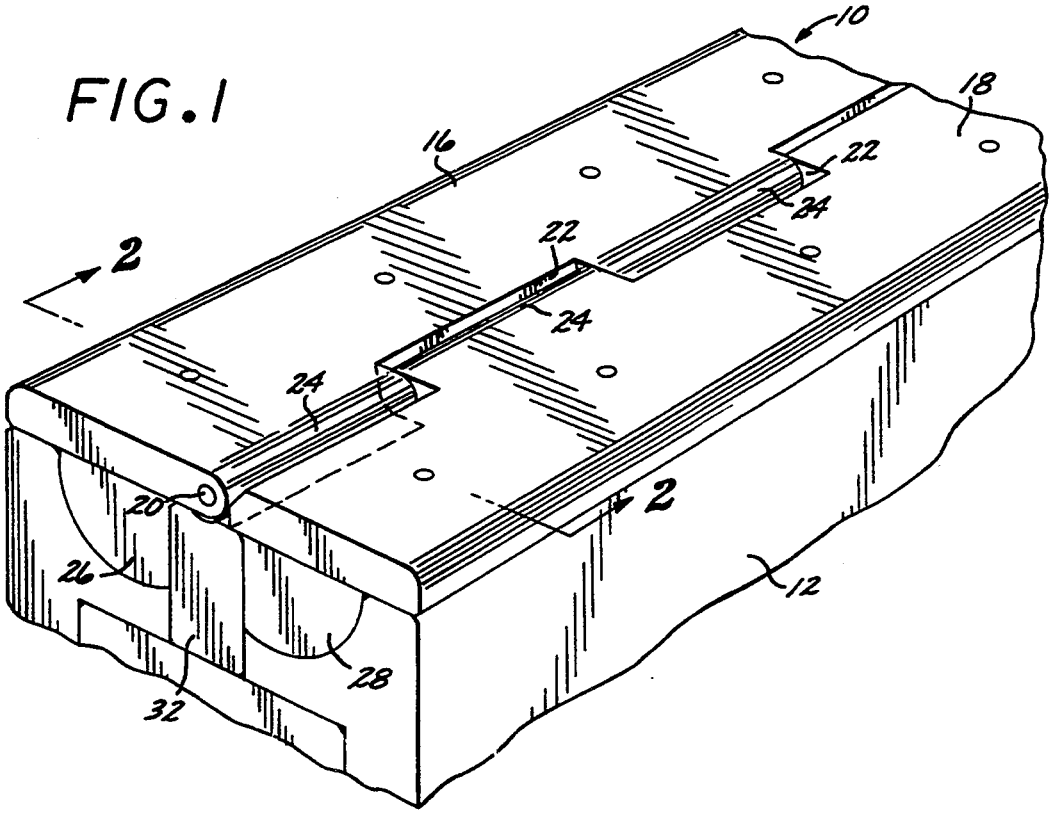
FIG. 1 is a perspective view of a bending die in accordance with the teachings of the present invention.
Figure 2:
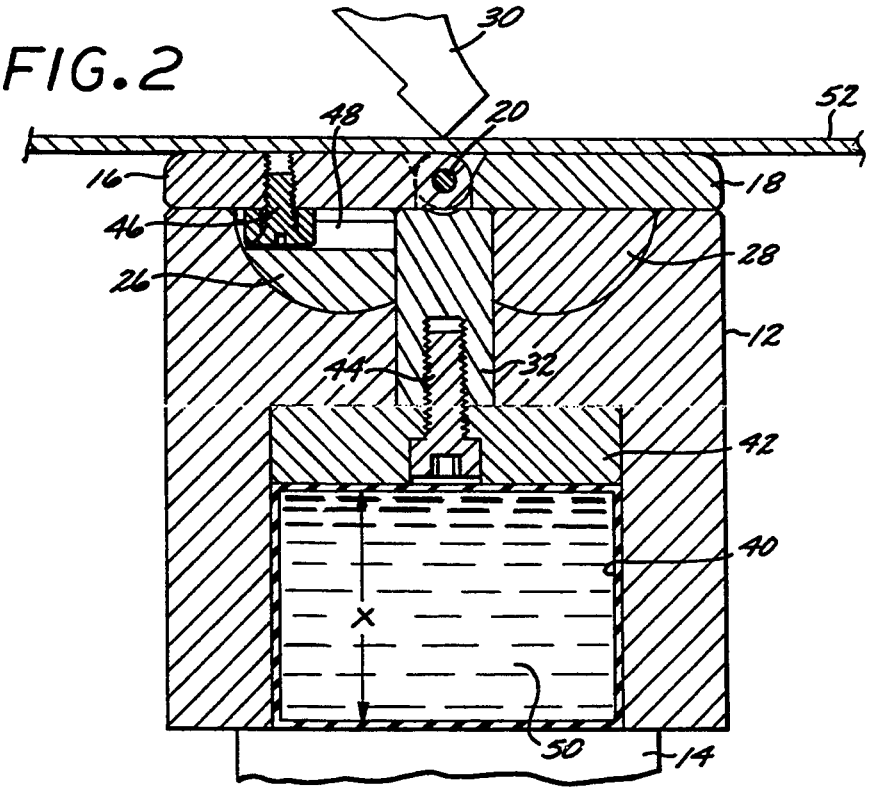
FIG. 2 is a cross-sectional view along line 2—2 of FIG. 1.

FIG. 1 is a perspective view of the lower die member 10 constructed in accordance with the teachings of the present invention. The lower die assembly is part of a machine body die assembly having an upper beam (not shown) which includes the tool or punch. Die assembly 10 includes a body member 12 for mounting on a die support member 14 or lower beam machine body (FIG. 2). A pair of hinged plate members, or die bars, 16 and 18 are adapted to angularly pivot about pivot pin 20. Each plate member has slots 22 formed therein to receive extensions 24 formed in the aligned, adjacent plate member as illustrated. A pair of rotor members 26 and 28 extend coextensively with plate members 16 and 18, respectively, along the entire length of body member 12, and act to convert the downward pressure of bending tool 30 (FIG. 2) into a rotating, or angular, motion. As will be set forth hereinafter, the angular orientation of each plate member is controlled by the vertical position of counterholder member 32, member 32 extending along the entire length of body 12. As shown in FIG. 2, pressure container, or bladder 40 is positioned within a cavity 60 (see FIG. 3) formed in body member 12 and extends substantially along the entire length thereof. A pressure plate 42 rests on the top surface of bladder 40 and is secured to counterholder 32 by a plurality of bolts (only single bolt 44 being illustrated) along the length thereof. A plurality of bolts (only single bolt 46 is illustrated) extends along the entire length of counterholder 32 and secures rotors 26 and 28 to plates 16 and 18, respectively, bolt 46 being adapted to slide within linear slot 48 (a plurality of linear slots are formed in rotors 26 and 28) so that rotors 26 and 28 can slide relative to plate members 16 and 18, respectively. Rotors 26 and 28 rest on body member 12 by gravitational force.

Expandable pressure container 40 generates surface tension, or bending pressure, to provide a uniformly distributed controlled bending pressure to pressure plate 42 and thus to counterholder 32. Inflatable container 40 can be made from any type of elastomeric material commonly known to those skilled in the art and which can resist chemical or physical degradation when in contact with the pressure transfer material 50 contained therein. In the preferred embodiment, the material has properties capable of resisting chemical or physical degradation when placed in intimate contact with heated hydraulic fluid, the preferred pressure transfer material. Hydraulic fuel may be an oil, an oil based derivative or a lubricating organic chemical. Specific polymers such as neoprene rubber may be used to successfully resist chemical and physical degradation. If the hydraulic fluid is aqueous, other types of container composition may be employed, recognizing the skill of those in the art to adapt and utilize the best composition. In addition, gas or gel may be used as pressure transfer material 50.

The container 40 must be made of a composition which not only resists chemical and physical degradation but provides adequate expansion and contraction properties sufficient to maintain its structural integrity over repeated hydraulic fluid operations. The size of the container 40 utilized in the bending die is dependent upon the amount of expanded, pressurized movement desired. Expandable containers such as container 40 have been available in the prior art, such as the device disclosed in U.S. Pat. No. 4,202,264.

The lower die assembly 10 operates as follows: flat metal stock 52 is initially positioned on the surface of plate members 16 and 18 as illustrated in FIG. 2 with tool 30 applied to metal stock 52 prior to the bending sequence. By controlling the pressure of the hydraulic fluid 50 within container 40 by the apparatus shown in FIG. 6, the height, or vertical dimension, X of container 40 is adjustable which in turn effects the vertical position of counterholder 32.

Figure 4:
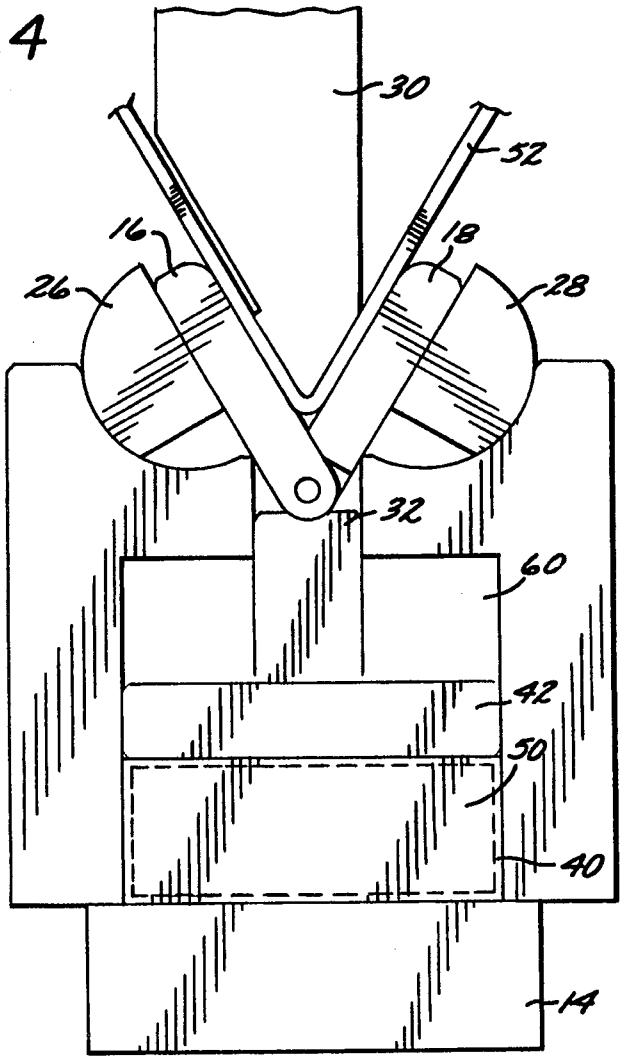
FIG. 4 is a view of the bending die shown in FIG. 1 with the die bars forming a 60 degree bend.
Figure 3:
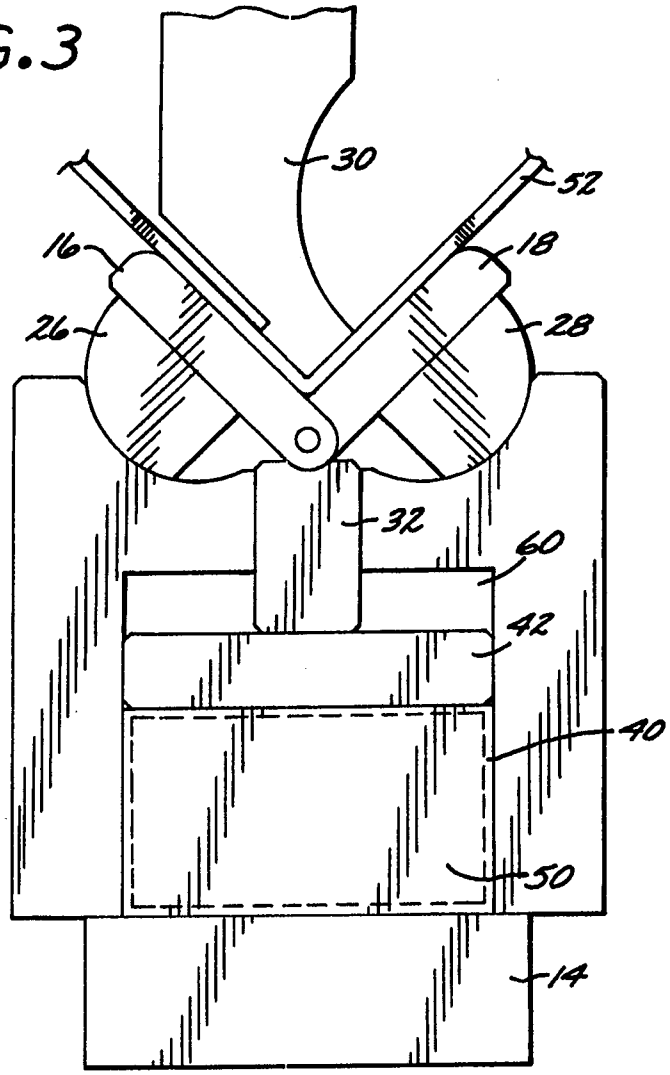
FIG. 3 is a view of the bending die shown in FIG. 1 with the die bars forming a 90 degree bend.

Referring now to FIG. 3, the pressure of material 50 within container 40 is selected so that container 40 has been reduced in the vertical dimension within cavity 60 to the fixed position illustrated. When pressure is applied to tool 30, rotors 26 and 28 convert the pressure to a rotary force on the lower surface of plate members 16 and 18, respectively, causing the plate members to assume the angular position shown (90 degrees), the tool forming a 90 degree bend in material 52. The fixed position of counterholder 32 prevents any further angular rotation and functions in effect to limit the angular bend in material 52. FIG. 4 illustrates the same process as in FIG. 3 with the exception that the pressure of material 50 within container 40 is selected such that the fixed vertical dimension of container 40 limits the downwardly extending position of counterholder 32 within cavity 60 such that plate members are limited to an angular orientation of 60 degrees, thus providing a 60 degree bend to material 52 as illustrated.

More specifically, the linear motion of punch 30 causes angular motion of plates 16 and 18 due to the pivot pin 20 that joins both plates. Bolt 46 is fixed to plates 16 and 18 and slides in the linear slot 48 on each rotor (slot 48 is only illustrated as formed in rotor 26). As the pivoting points on plates 16 and 18 move downward, the plates themselves move in an angular direction due to the rotation of rotors 26 and 28. Since bolt 46 is fixed to plates 16 and 18, the bolt has rotational and translational motion as punch 30 moves downwardly. This rotational and translational motion in turn causes rotors 26 and 28 to slide relative to plates 16 and 18, respectively, due to the bolt 46 sliding in the linear slots formed in rotors 26 and 28.

It should be noted that rotors 26 and 28 are not mechanically secured to body 12 but simply rest thereon by gravitational force. Similarly, pressure plate 42 is not mechanically secured to bladder 40 but rests thereon by gravitational force and plates 16 and 18 are not mechanically secured to the top surface of counterholder 32 but simply rest thereon.

Figure 5A:
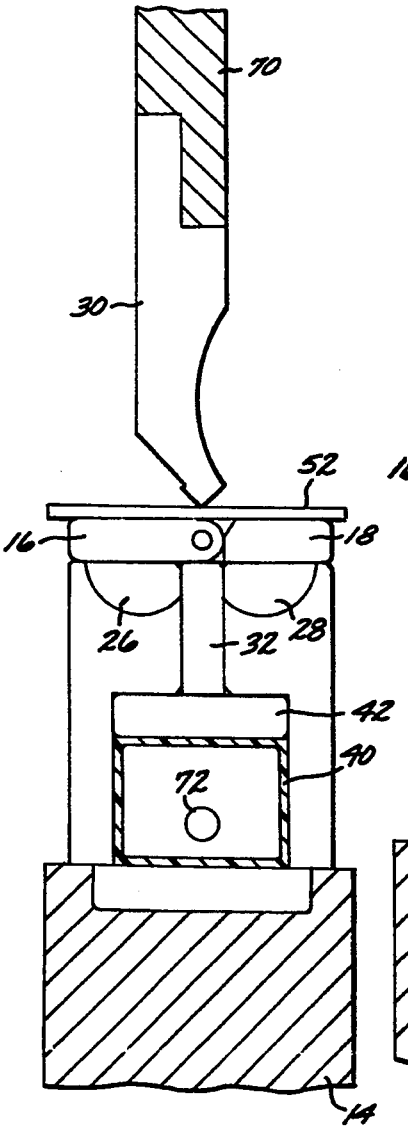
FIGS. 5(*a*)–5(*c*) illustrate the operation of the flexible bending system of the present invention.
Figure 5B:
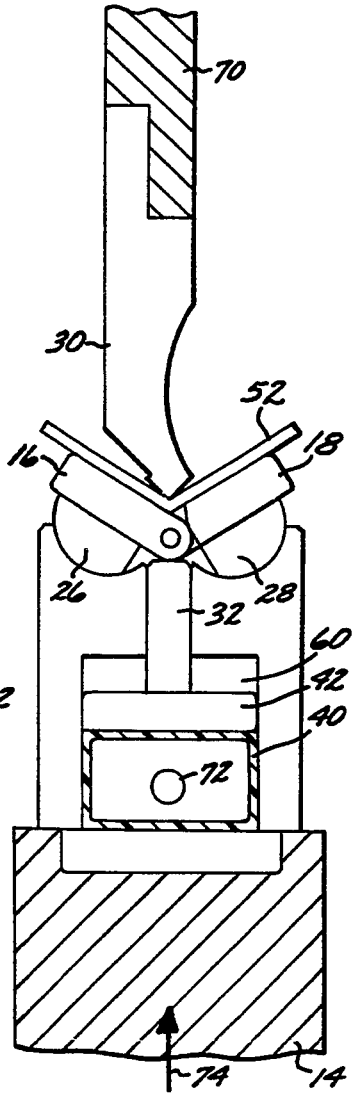
Figure 5C:
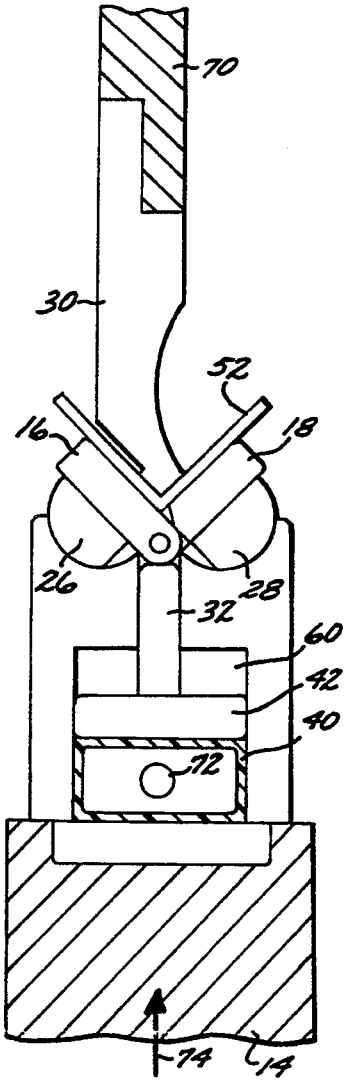

FIGS. 5(*a*)–5(*c*) explains in somewhat more detail the operation of the flexible bending system of the present invention.

In particular, the figures illustrate the upper beam portion 70 of the machine body and the lower beam portion 14 of the machine body and a hydraulic oil intake 72 in bladder 40. FIG. 5(*a*) illustrates the die assembly prior to the application of a bending force to material 52.

FIG. 5(*b*) shows a bending force, illustrated by reference arrow 74, applied by the bending machine to material 52. If the internal pressure of bladder 40 exceeds a preselected point, the system for controlling the material bending (FIG. 6) opens a sevo valve to maintain the preselected pressure. A reduction in hydraulic oil volume in bladder 40 enables lower beam 14 to move upwards, causing plate members 16 and 18 to fold in at an angle, bending material 52 in turn. Alternatively, if the bending force is exerted by punch, or tool, 30, the reduction of the hydraulic oil volume in bladder 40 causes counterholder 32 to move downward along with hinge 20 of the hinged plate members 16 and 18, causing material 52 to bend, as shown in FIG. 5(*c*).

The position of the machine lower beam 14 and the volume of the hydraulic oil in bladder 40 controls the stroke position of counterholder 32 which in turn controls the initial angle of plate members 16 and 18 and the bending angle of material 52.

Figure 6:
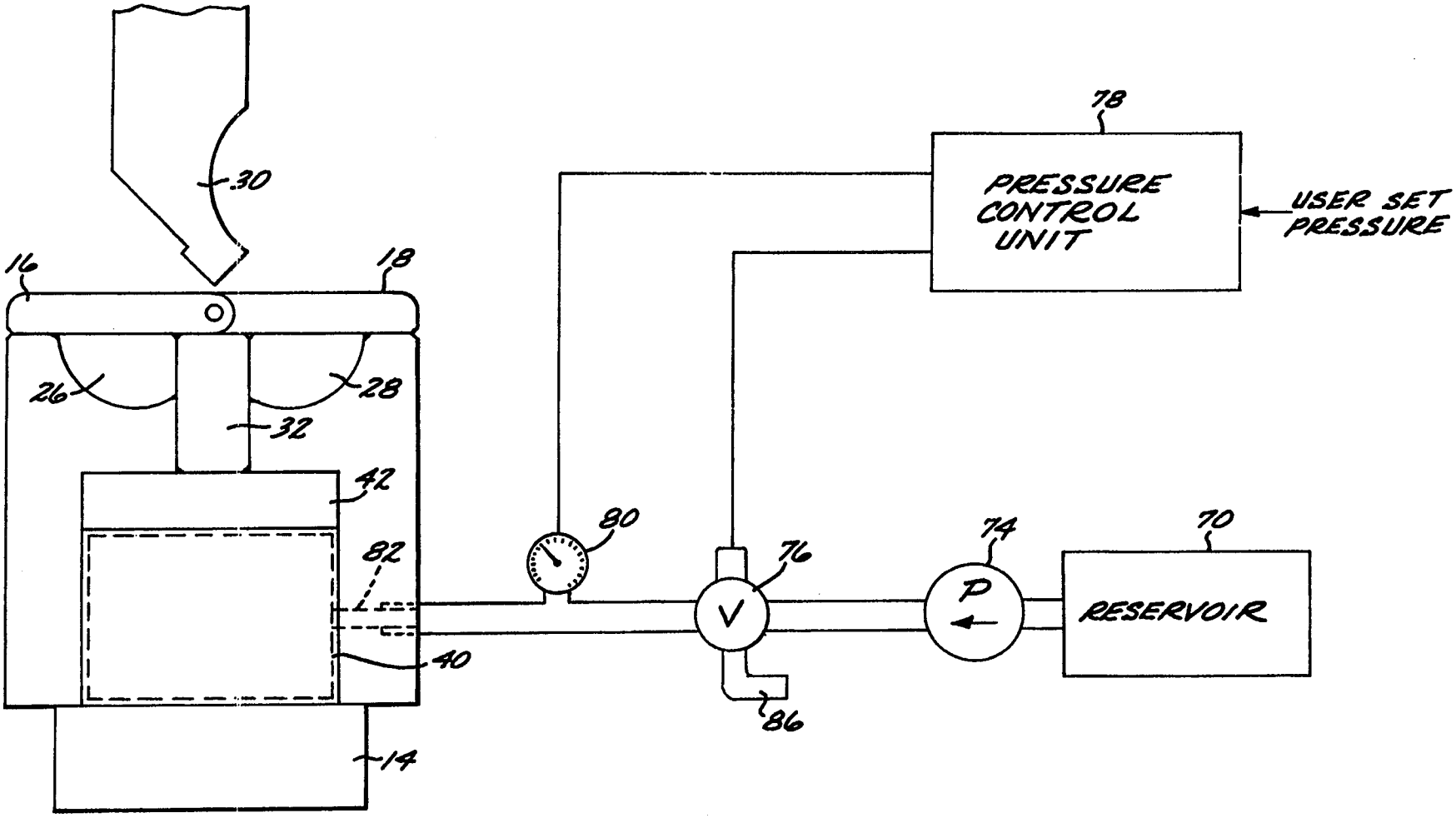
FIG. 6 illustrates the bending control system of the present invention.

FIG. 6 is a simplified schematic diagram illustrating the bending control system of the present invention. Pressure material 50, such as hydraulic oil, stored in reservoir 70, is applied to expandable container, or bladder, 40 via fluid line 72, a pressure flow gauge 74 and servo control valve 76 being interposed in the fluid line as illustrated. A pressure control unit 78, responsive to the desired user pressure input which corresponds to the angularly bend to be formed in the material, compares the pressure of the fluid material, as measured by pressure gauge 80 and adjusts valve 76 in response thereto such that the pressure corresponds to the desired setting. An inlet port 82 connects the interior of bladder 40 to the fluid line 72 as illustrated.

The position of machine lower beam 14 is controlled by a commercially available control unit, such as the NC9-EX gauging system sold by U.S. Amada, Ltd., Buena Park, Calif., and the hydraulic oil volume and thus, the position of counterholder 32 is programmed by the pressure control unit 78, control unit 78 being a conventional microcomputer driven process device. Control unit 78 maintains the position of counterholder 32 at the preprogrammed internal pressures of bladder 40 and continuously checks the bladder internal pressure and the position of counterholder 32 and controls the opening of servo valve 76 and the direction of oil flow to maintain them (oil is returned via a hydraulic return line 86).

The bending control unit 78 maintains the counterholder 32 at the position corresponding to the preprogrammed bladder internal pressure until the machine operator takes the appropriate action to change the pressure.

Although the present invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material through the teaching of the invention without departing from its essential teachings.

What is claimed is:

1. A system for bending flat metal stock comprising: means for supporting a tool member;

hinged plate members for supporting said flat metal stock;

rotatable means secured to and positioned below said hinged plate members for rotating said plate members to a predetermined angular position when a force is applied to said plate members;

means movable in the vertical direction and coupled to said hinged plate members to apply a force thereto;

an expandable pressure device having a wall portion in contact with said movable means, a pressure controllable material being enclosed therein, the position of said wall portion being dependent upon the pressure of the material within said container;

means for controlling the pressure of said material whereby the position of said movable means is controlled to provide the desired angular orientation between said plate members; and means positioned below and in contact with said pressure device for moving said metal stock into contact with said tool member whereby a bending force is applied to said metal stock.

2. A system for bending a flat metal stock comprising:

means for supporting a tool member;

hinged plate members for supporting said flat metal stock;

rotatable means secured to and positioned below said hinged plate members for rotating said plate members to a predetermined angular position when a force is applied to said plate members;

means movable in the vertical direction and coupled to said hinged plate members to apply a force thereto;

an expandable pressure device having a wall portion in contact with said movable means, a pressure controllable material being enclosed therein, the position of said wall portion being dependent upon the pressure of the material within said container; and means for controlling the pressure of said material whereby the position of said movable means is controlled to provide the desired angular orientation between said plate members, said tool applying said vertical bending force to said metal stock.

3. A die for use with a tool for bending flat metal stock comprising:

means for supporting a pair of pivotable plate members, said pivotal plate members having upper and lower surfaces, the upper surfaces of said plate members adapted to support a piece of flat metal stock;

means coupled to the lower surfaces of said plate members for converting an essentially vertically force applied to the metal stock to a rotary force applied to said plate members whereby said plate members assume a selected angular orientation with respect to each other;

means coupled to said plate members for limiting the angular orientation of said plate members to a predetermined value;

an expandable pressure device coupled to said limiting means, a pressure controllable material being enclosed therein, said expandable pressure device comprising an enclosed container having at least one wall portion, the position of said wall portion being dependent upon the pressure of the material within said container; and means for controlling the pressure of said material whereby the limit position of said limiting means is selected to provide the desired angular orientation between said plate members.

4. The die of claim 3 wherein said vertical force is applied to said metal stock by said tool.

5. The die of claim 3 wherein said die includes means positioned below said supporting means for applying said vertical force to said metal stock.

6. The die of claim 3 wherein said plate members and said supporting means extend substantially along the entire length of said die.

7. The die of claim 6 wherein said enclosed container extends substantially along the entire length of said die.

8. The die of claim 6 wherein said material comprises a hydraulic fluid.

* * * * *